US005529267A

United States Patent [19]

Giras et al.

[11] Patent Number: 5,529,267

[45] Date of Patent: Jun. 25, 1996

[54] RAILWAY STRUCTURE HAZARD PREDICTOR

[75] Inventors: Theo C. Giras, Pittsburgh; Michael E. Colbaugh, Levelgreen; C. Franklin Boyle, Ross Township, all of Pa.

[73] Assignee: Union Switch & Signal Inc., Pittsburgh, Pa.

[21] Appl. No.: 505,745

[22] Filed: Jul. 21, 1995

[51] Int. Cl.[6] ..... B61L 1/00

[52] U.S. Cl. ..... 246/120; 246/121; 246/246; 385/13

[58] Field of Search ..... 246/120, 121, 246/122 R, 246, 49, 473, 167, 218, 219, 249, 270 R; 73/786, 788, 800; 359/109; 385/12, 13

[56] References Cited

U.S. PATENT DOCUMENTS

| | | | |
|---|---|---|---|
| 2,158,013 | 5/1939 | Pflasterer | 246/121 |
| 4,200,856 | 4/1980 | Gilcher | 338/2 |
| 4,306,694 | 12/1981 | Kuhn | 246/121 |
| 4,362,057 | 12/1982 | Gottlieb et al. | 374/4 |
| 4,477,725 | 10/1984 | Asawa et al. | 385/13 |
| 4,498,650 | 2/1985 | Smith | 246/122 R |
| 4,560,016 | 12/1985 | Ibanez et al. | 177/210 R |
| 4,619,425 | 10/1986 | Nagel | 246/34 R |
| 4,701,614 | 10/1987 | Jaeger et al. | 280/228 |

(List continued on next page.)

FOREIGN PATENT DOCUMENTS

| | | | |
|---|---|---|---|
| 3307246 | 9/1985 | Germany . | |
| 3537588 | 4/1987 | Germany . | |
| 272362 | 10/1989 | Germany | 246/121 |
| 3815152 | 11/1989 | Germany . | |
| 3844663 | 6/1990 | Germany . | |
| 806514 | 2/1981 | U.S.S.R. | 246/121 |
| WO83/00744 | 3/1983 | WIPO . | |

OTHER PUBLICATIONS

Vengsarkar, Greene, Fogg & Murphy, "Spatially Weighted, Grating-based, Two-mode, Elliptical-Core Optical, Fiber Vibration Sensors", *Optics Letters,* vol. 16, No. 21, pp. 1707–1709 (Nov. 1, 1991).

An accumulation of articles and papers collectively referred to as "Extrinsic Fabry-Perot Interferometric (EEPI) Optical Fiber Sensors for Material and Structural Analysis: Recent Developments and Applications," published by the Fiber & Electro-Optics Research Center at Virginia Tech University, dated Oct. 1991.

Vengsarkar, Greene & Murphy, "Photoinduced Refractive-index Changes in Two-Mode, Elliptical-core Fibers: Sensing Applications," *Optics Letters,* vol. 16, No. 19, pp. 1541–1543 (Oct. 1, 1991).

Boiarski & Nilsson, "New Fiber Sensors Take Power Plant's Temperature," *Photonics Spectra,* pp. 92–94 (Sep. 1991).

Claus, "Fiber Sensors as Nerves for 'Smart Materials'," *Phototonics Spectra,* p. 75 (Apr. 1991).

Jungbluth, "Optical Fibers Measure Strain and Temperature," *Laser Focus World,* p. 155 (Jan. 1991).

Murphy, Miller, Vengsarkar and Claus, "Elliptical-Core (List continued on next page.)

*Primary Examiner*—Mark T. Le

*Attorney, Agent, or Firm*—Buchanan Ingersoll

[57] ABSTRACT

A hazard predictor that processes both rail and superstructure measurements to predict some potentially hazardous conditions on a railway structure. Measurement is collected in real time with the aid of fiber optic sensor based linear array mesh, and processed with a neural network. Sensors placed under the rail and sensors placed laterally of the rail provide data collection in real time both during occupied and unoccupied periods. In some embodiments the measurement data is compressed into two signatures which can be represented as two vectors. The collinearity of the vectors and the angle between the vectors are utilized to interpret the data as to track conditions. The angle between the descriptors can be used to predict the severity of degradation of the structure. The predictor can be used to manage maintenance of the structure and interface with existing railway signalling equipment to provide traffic management.

22 Claims, 5 Drawing Sheets

U.S. PATENT DOCUMENTS

| | | | |
|---|---|---|---|
| 4,701,866 | 10/1987 | Harrison et al. | 364/550 |
| 4,812,645 | 3/1989 | Griffiths | 385/13 |
| 4,909,594 | 3/1990 | Haese et al. | 385/13 |
| 4,918,305 | 4/1990 | Wlodarczyk et al. | 385/13 |
| 5,026,141 | 6/1991 | Griffiths | 350/96.29 |
| 5,056,884 | 10/1991 | Quinlan | 385/13 |
| 5,109,443 | 4/1992 | Hill et al. | 385/13 |
| 5,129,606 | 7/1992 | Rodems et al. | 246/249 |
| 5,145,131 | 9/1992 | Franke | 246/122 R |
| 5,240,643 | 8/1993 | Buckley | 252/408.1 |
| 5,330,136 | 7/1994 | Colbaugh | 246/122 R |
| 5,397,083 | 3/1995 | Thomas | 246/121 |

OTHER PUBLICATIONS

Two–Mode Optical–Fiber Sensor Implementation Methods," *Journal of Lightware Technology,* vol. 8, No. 11, pp. 1688–1696 (Nov. 1990).

Wohlstein, "Fiberoptics For Practical Sensing Applications (II)," *Lasers and Optronics,* pp. 63–65 (Mar. 1990).

Garwood, "Fiber–Optic Sensors: Working on the Railroad," *Sensors,* pp. 43–44 (Oct. 1989).

Wohlstein, "Using Fiberoptics For Practical Sensing," *Lasers and Optronics,* pp. 73–76 (Jul. 1989).

Shadaram, "Sensing with Fibers," *Photonics Spectra,* pp. 117–118 (Jun. 1989).

RAILWAY STRUCTURE HAZARD PREDICTOR

BACKGROUND OF THE INVENTION

Most railway track is at grade and supported on ties constructed of wood, concrete or other materials. At grade track is usually supported upon ballast which can include crushed stone or other suitable materials to support the weight of high capacity trains. Because of the high weight of a fully loaded train and the dynamics of the track as the train is moving at speed along a track section, certain amounts of vibration and movement of the individual rails may occur. In this regard the at-grade ballast and the compressibility of the railway ties provides an acceptable support for the railway vehicle. However when a rail vehicle is required to cross an area where ground support may be inadequate, such as a stream or river crossing, a more rigid structure such as a bridge is required. A superstructure such as a bridge may often support the rails in a more rigid fashion than the at-grade crossing. But bridges are generally of a short length, and the lack of ballast does not effect the operation of the vehicle. In addition, some bridges and other structures because of related considerations may be required to be movable, such as drawbridges or turntables. In such movable structures the rail is temporarily broken so that the section of bridge can be moved. It has been common practice in many sections of railway track to utilize track circuits to monitor the integrity of the rails. Circuits operating in such a fashion are often referred to as "broken rail" detection circuits. In such circuits a rail current in the rails is monitored and, if the continuity is interrupted, this condition can be considered an indication that the rail has become broken or separated, possibly at a joint or other location. Such broken rail circuits are often incorporated along with existing track circuits which indicate the occupation of the track by a rail vehicle. Some railway track occupancy circuits also provide a portion of rail integrity monitoring. In addition, many superstructures such as bridges that are movable may include electrical or mechanical interlocks which provide an indication that the bridge or structure is opened, or closed such that the rails are properly mated at sections where they have been separated for the purpose of opening the structure.

Generally devices that detect structural misalignment on a movable structure are made to interlock when the bridge or structure is returned to its normal position. Such interlocking may be designed only to detect crude misalignment while remaining insensitive to the normal vibration and strain associated with full loaded trains operating over the respective section of track. Such devices are of a nature so as to be relatively insensitive to the presence or absence of rail vehicles on the section of track in which they are interlocked.

However, because broken rail detectors have traditionally been utilized at grade, the integrity of the grade has been assumed as the earth does not usually move without still providing adequate support for the rails. However, superstructures such as bridges can deteriorate or sustain damage that makes the bridge have questionable structural integrity without breaking the rail. In addition, track circuit broken-rail detection will usually operate in a mode to monitor track integrity while they are unoccupied. This is because such circuits depend upon rail current, and such current is shunted when a rail vehicle occupies a section of track.

Therefore it would be desirable to have a measure of hazard prediction for both the integrity of the rail and the supporting structure that would operate during both occupied and unoccupied track conditions. It would also be desirable if such system could in fact operate over a period of time so as to detect deterioration in the rail and support structure which may occur gradually. The system should also indicate when it is desirable to inspect the specific section of track prior to an adverse condition occurring. In addition, the system should indicate spontaneous structural damage due to high impact such as wrecks.

SUMMARY OF THE INVENTION

The invention utilizes a hazard predictor that processes spatial real time measurements of both rail and superstructure to predict some potentially hazardous conditions. Measurement can be collected in real time with the aid of a fiber optic based sensor array and processed with a neural network. The hazard predictor processes information to detect hazardous conditions related to rail integrity and/or basic superstructure movement and conditions. In addition, the hazard predictor can provide real time data collection of rail and bridge integrity measurements, thereby supporting a preventive maintenance strategy or critical alarm analysis based on the data that is communicated to a central traffic control (CTC) system. The fiber optic sensor based array or other sensors are installed such that the spatial and/or real time measurement collection can be made available to the hazard predictor so as to describe the conditions of the rail, the superstructure, and the relative structure between the superstructure and the rail. In some embodiments the fiber optic properties of the sensor is used to structure a round-robin passive bus architecture that instantiates the entities of a hierarchical database that is then processed with a neural network. Fiber optic sensory paths can be installed with optical delay units such as loops that both spatial and real time data collection results.

The measurement data collected by the fiber optic based sensor array can be processed with the aid of a vital neural network architecture or other analyzing control that reduces the sensory measurement information to signatures that become rail and bridge integrity descriptors. The measurement data is compressed into two signatures which can be represented as two vectors. The first signature describes the integrity alignment of the rail track. The second signature describes the superstructure, bridge, integrity. In the normal mode of operation these two vectors can be considered as collinear. However, as structural integrity degrades, either rail track, superstructure, or both, the signature descriptors no longer remain collinear. The angle between the descriptors can be used to predict the severity of the degradation of the structure. The signatures can be identified or classified by a neural network. Such neural network can be fault tolerant to transient hardware or process failures. Once an angle limit indicative of a hazard is detected, the signatures can be reverse searched to establish the spatial location of the potential hazard or hazards. If the hazard or hazards are validated, a signalling system can be activated to indicate a block on any track section. The railway signalling equipment can be used to block the respective section so as to warn vehicles that may be about to enter the structure zone containing the hazard. In addition, when a hazard condition is detected the information may be communicated to the central traffic control facility to enable further traffic constraints to be implemented. The data processing can be implemented with an information coded technology that allows the processor to be vital, and at the same time the vitality can be quantified with an analytical model to provide a robust verification and validation of the entire hazard processor.

DETAILED DESCRIPTION OF CERTAIN EMBODIMENTS

Figure 1A:
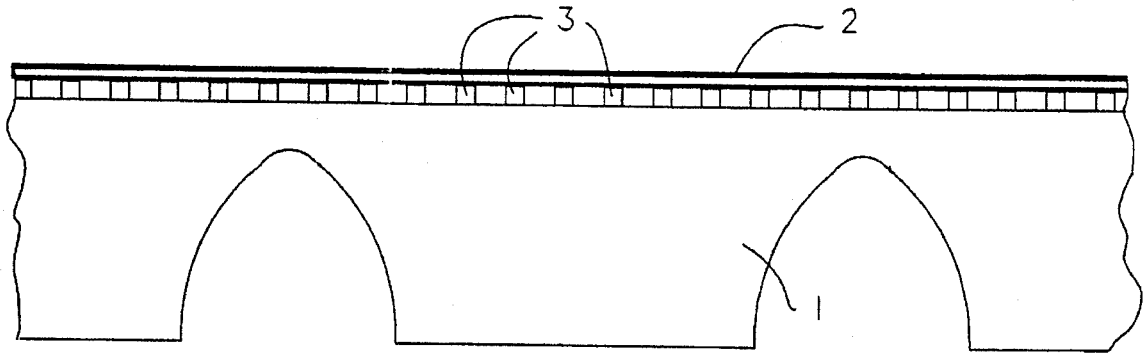
FIG. 1*a* shows a superstructure, bridge, supporting a track section having two rails operating with a hazard predictor.

The apparatus and method of the invention can be used on many existing railway structures. For the purposes of describing some embodiments of the invention, the superstructure will be assumed to be a bridge, and, in fact, the monitoring of bridges is one important application of the invention. It is understood that the apparatus and method can equally be used to monitor other mechanical structures. As shown in FIG. 1*a*, a superstructure, in this case a bridge 1, is used to support railway ties 3 and a set of railway tracks 2 thereupon. As shown in this figure, the bridge is a simple multiple arch span. Other bridge structures, including movable bridges such as drawbridges can also be monitored by the hazard predictor. While the ties 3 shown in FIG. 1*a* are assumed to be wood, a typical railway tie material, other ties material may be used to equally benefit from the invention. In addition, the rail to tie mount used in this example will be somewhat conventional and may utilize rail spikes, but it is understood that other rail to superstructure connections can utilize the invention. Wooden ties are used as an example because of their common availability in the railway industry; concrete ties, metal supports or other rail mounting means can be used.

Figure 1B:
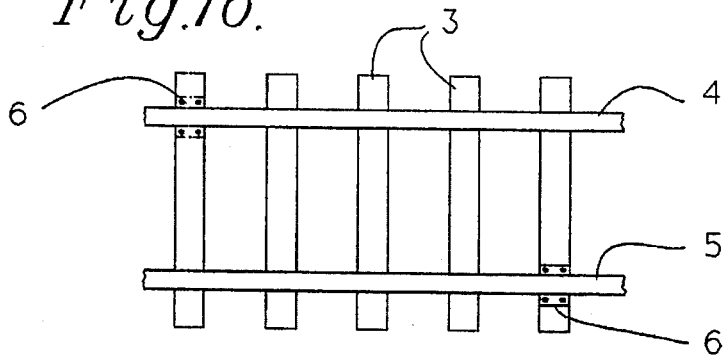
FIG. 1*b* is a plan view of a two rail track section with two sensor units.

FIG. 1*b* shows a section of track composed of two rails 4 and 5, mounted on ties 3. As shown in FIG. 1*b*, two sensor units 6 are also mounted on the section of track. As shown, one sensor 6 is mounted on one rail and a second sensor 6 is mounted on the other rail. Depending on the particular application and the mechanical nature of the structure which it is desired to monitor, one or more sensors may be placed on a given rail. In some other applications it will be sufficient to place a single sensor unit on a rail of the track section. Some applications may make it desirable to have multiple sensors on the same rail of a track section, or multiple units on both rails of a section of track which it is desired to monitor. In some applications where a short section of track is desired to be monitored, a single sensing unit 6 mounted on one track may be sufficient to meet the monitoring needs.

Figure 2A:
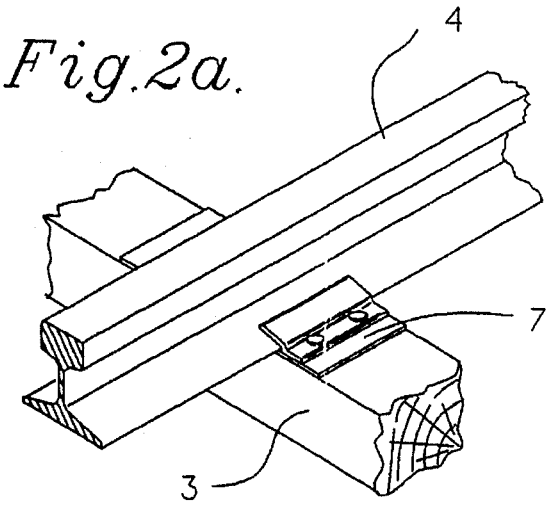
FIG. 2*a* is a partial view of a rail portion of the track shown in FIG. 1*a* showing the tie plate interface between the rail and tie.

FIG. 2*a* shows a single sensor unit mounted to a rail 4 and secured to a tie 3 and tie plate 7. In this application optical fiber sensors are used adjacent the rail and the tie plate to sense strain and/or relative movement.

Figure 2B:
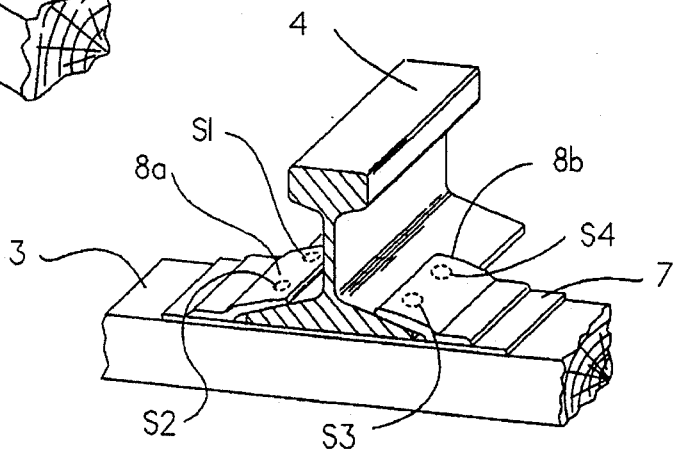
FIG. 2*b* is a cross-section of a structure such as that shown in FIG. 2*a*.

FIG. 2*b* shows a sensor unit of FIG. 2*a* in more detail. Rail 4 is mounted on tie 3 by means of a tie plate 7. The rail and tie plate 7 may be secured to the tie by any conventional means, such as for example, railway spikes. While this embodiment uses a relatively conventional tie plate 7, other embodiments may utilize special tie plates adapted to position sensors. Rail retainers 8*a* and 8*b* are positioned adjacent the tie plate to generally fix the rail from lateral movements on the tie 3. Fiber strain sensor S2 is positioned under the rail to detect strain of the rail against the tie plate when a train wheel imposes a load in close proximity to the sensor unit. Sensors S1, S3, and S4 are mounted within or along the inner surface of the rail retaining bars 8*a* and 8*b*. The sensors S1, S3 and S4 are made to be sensitive to lateral forces and movement of the rail. Sensor 1 senses right to left (as shown in FIG. 2*b*) lateral strain of the rail. Sensors 3 and 4 sense strain in the opposite direction (i.e., left to right as shown in FIG. 2*b*). Sensors 3 and 4 are arranged on opposite ends of the right rail retaining bar, in such a way as to sense twisting of the tie plate with respect to the rail orientation. The sensors can be designed to exert a preload pressure or no-load in the unstrained state. Strain due to stress in the rails, weakening of surrounding tie plates, or misalignment of bridge supports can be detectable by sensors S2 and S4. As shown in the arrangement of FIG. 2*b*, sensors S2 and S4 have little effect on sensors S1 and S3 so that lateral strain can be distinguished from the compressive strain of the presence of a railway vehicle, or train. While this embodiment uses optical fiber strain gauges, other sensors which can be positioned adjacent to the rail can also be used to sense the presence of the train and relative movement of the rail on the superstructure.

Figure 2C:
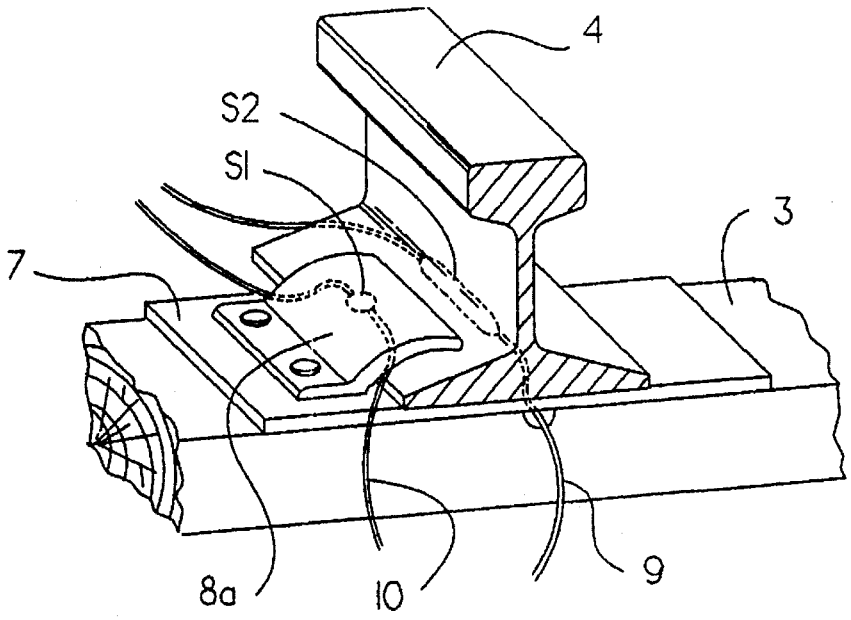
FIG. 2*c* is a more detailed portion of the rail of FIG. 1*b* shown in partial section showing a sensor viewed from the left-hand side.

As shown in FIG. 2*c*, the sensors, such as optical fiber sensors can be in some embodiments mounted directly beneath the rail, or between the rail and the rail bars or retainer. As shown, sensor S2, which could be a fiber optic sensor, is positioned directly beneath the rail 4 and adjacent the tie plate 7. In some applications provision may be made in the tie plate to easily accommodate the sensor and the connecting cable 9. In other embodiments the sensor may be designed so as to specifically accommodate the utilization of standard rail, tie plates, and retainer bars. In addition, sensor S1 is positioned between the retainer bar 8*a* and the rail 4. Cable, such as a fiber optic cable, 10 can connect the sensor S1 into an appropriate circuit. While fiber optics are shown in the embodiment of FIG. 2*c*, other sensor elements could also be utilized.

Figure 2D:
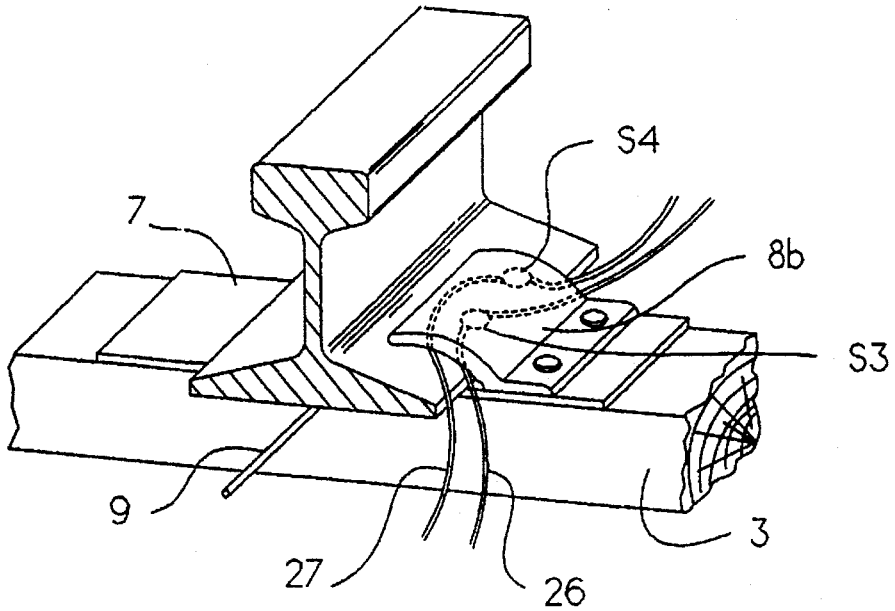
FIG. 2*d* is a more detailed portion of the rail such as shown in FIG. 1*b* in a partial section showing a sensor viewed from the right-hand side.

FIG. 2*d* shows the right-hand side of a rail segment. Cable 9, which is beneath the rail in the segment, is shown in the center of the rail and the tie plate 7. However, other positions which sense the vertical loading on the rail are equally appropriate. This figure shows only one of many embodiments covered by the invention. Similarly to that described for sensor S1, sensors S3 and S4 are located between the rail and the retainer bar 8*b*. While the sensors may be constructed so as to be readily adaptable to standard rail retainer bars or clamps, other embodiments may utilize a retainer which has been modified to specifically fit and/or position the respective sensors. While sensors shown in FIG. 2*d* as S3 and S4 utilize an optical fiber, and respective optical fiber cables 26 and 27, other sensors may be utilized, and other fiber optic arrangements may be utilized for this sensory application.

Figure 2E:
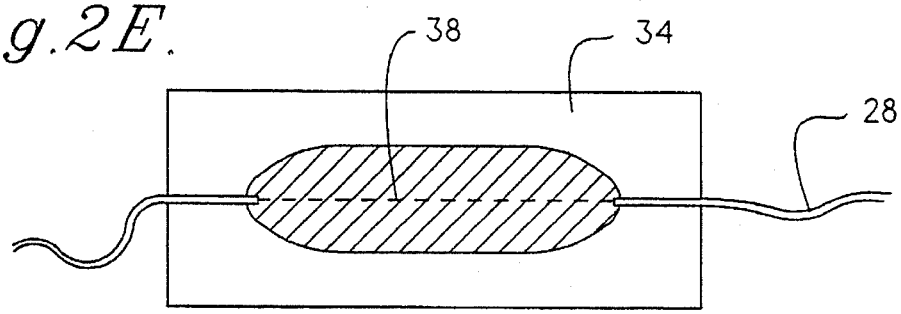
FIG. 2*e* is a partial cross-section of one embodiment of a fiber optic sensor device as utilized in the rail mounted configurations of FIG. 2.

FIG. 2*e* shows one type of optical fiber sensor in which an optical fiber cable 28 penetrates a casing 34 which encases a fiber optic element 38. The casing 34 is positioned between the two rigid members, such as the rail and tie plate, or the rail and retainer, or other physical structures such that forces impressed on the casing 34 are transmitted to the fiber element 38 to produce a change in the optical characteristic of the sensor which is indicative of the associated forces.

Figure 2F:
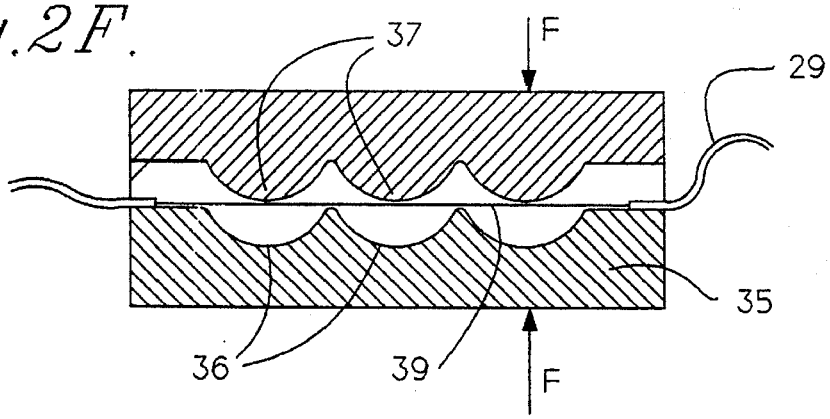
FIG. 2*f* is a partial cross-section of one embodiment of a fiber optic sensor as can be used in the rail attachments shown in FIG. 2*a* through 2*d*.

FIG. 2*f* shows an embodiment having an optical fiber cable 29 which is inserted in a casing 35. The casing 35 has a center portion having a number of troughs 36 and a number of peaks 37. The optical fiber element 39 is sandwiched between respective portions of the casing 35, such that the peaks and troughs cause respective stress and strain in the fiber element 39 which cause its optical characteristics to be modified in responses to forces F.

While certain optical fiber elements have been shown as sensors, it is to be understood that the invention includes other sensors or optical sensors which are known or which can be developed to produce the necessary sensed response to the presence of a railway vehicle, and the rail dynamics discussed herein.

Figure 3:
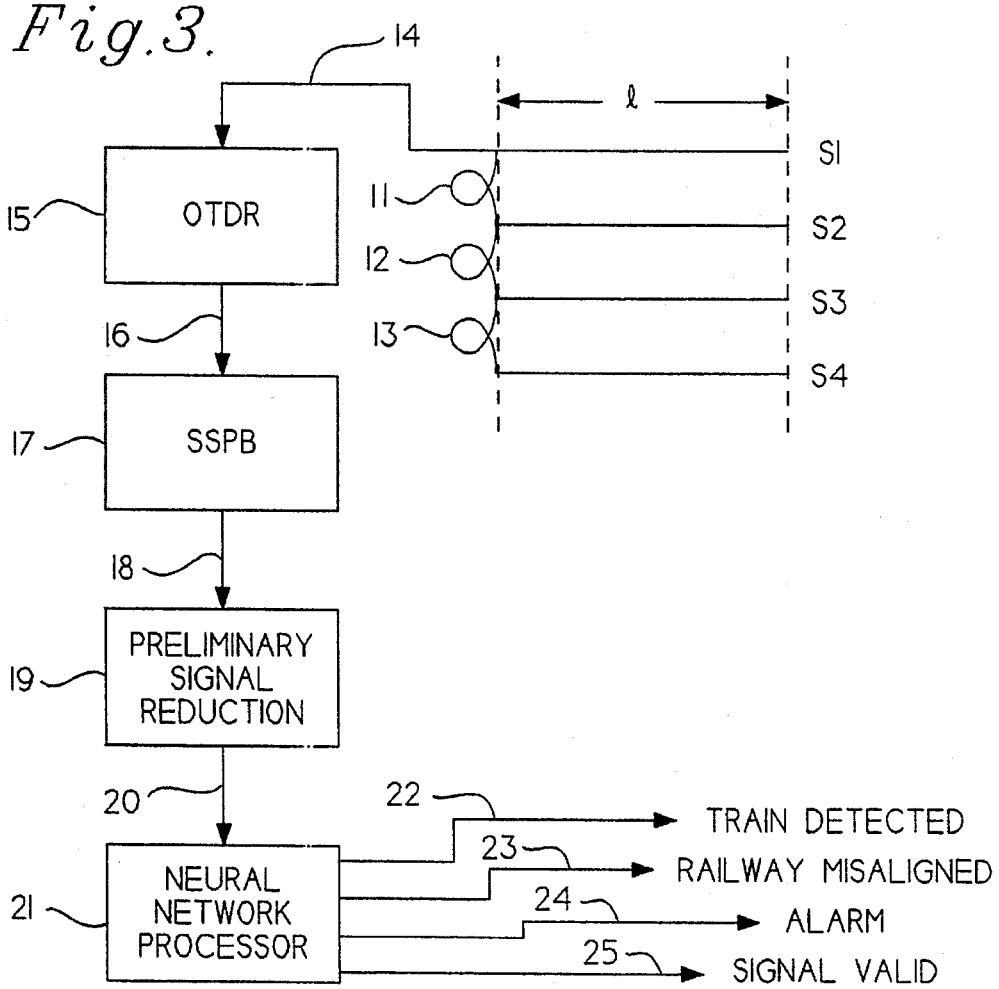
FIG. 3 is a diagrammatic circuit showing an embodiment of a hazard predictor with optical sensors and process equipment.

FIG. 3 shows a block diagram of a monitor device which includes a single sensor unit having four optical fiber sensors, S1 through S4. Sensors S1 through S4 have equal length, l. They are connected together through three equal lengths, l, of looped optical fiber material 11, 12, 13. The looped lengths 11 through 13 provide an unsensitized delay between each sensor. Other loop lengths greater than the length l could also be used. An optical time domain reflectometer (OTDR) is connected through a series of optical splitters which channel a portion of light emitted from the OTDR to each of the optical sensors S1 through S4. As a result of the arrangement of S1 through S4 and the additional loop lengths 11 through 13, the optical fiber 14 that is connected to the sensors S1 through S4 carries the information from all four sensors in a seriatim arrangement to the OTDR. The optical time domain reflectometer 15 detects changes in reflected light of an emitted optical signal to line 14. In addition, the OTDR can convert such optical signals into an electrical signal which may be output, as 16, to a sampler signal process buffer (SSPB).

Figure 4:
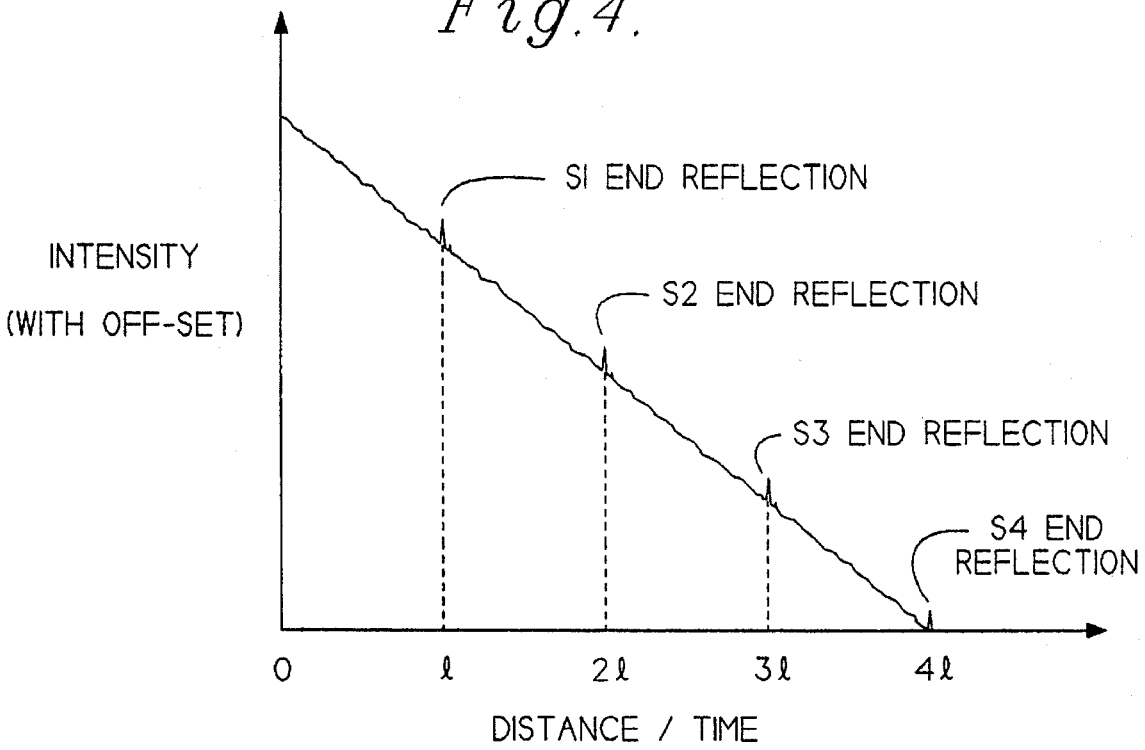
FIG. 4 is a graphic representation of the output signal from an optical time domain reflectometer.

The output of the OTDR can be an electrical signal as shown in FIG. 4 or it could be optically processed. FIG. 4 is a graph showing the intensity of the back-scattered light from the respective sensors S1, S2, S3, and S4 as a function of time or distance. In this case, the distance is shown in increments of length l, sensor length. Sensor S1 has an S1 end reflection at distance l. Because of the loop delay, sensor S2 has an end reflection at a distance of 2 l. S3 has an end reflection at 3 l, and S4 at 4 l. Using the three respective delay loops, 11, 12, 13 creates the serial signal of the respective sensors S1 through S4. Signal 16 can be used with a digitalizing sampler and differential signal processor, 17, which can convert the OTDR output signal to a set of four relative back-scattered (reflective) curves. The four reflective curves can be buffered and stored as four separate strain map curves. The output of the SSP is a set of signals 18 that are characteristic of the time/strain experienced by sensors S1 through S4.

Figure 5:
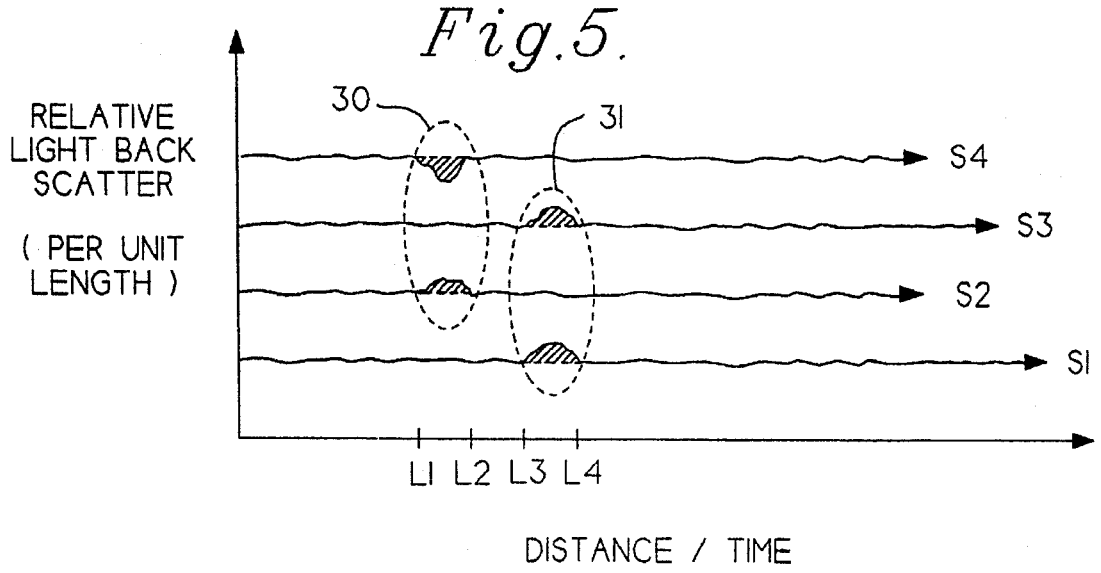
FIG. 5 is a graphic representation of an output of a sampler signal processor buffer for a rail sensor equipped with four sensor sites.

FIG. 5 shows a set of four curves representative of the type of information that can be sensed by the optical fiber sensors S1 through S4. The relative light back-scatter is per unit length. A sensed condition is shown for each of the sensors S1 through S4. Based upon the specific characteristics of the sensors, probable rail and structure conditions can be predicted. The condition as shown in area 30 can be indicative of a probable misalignment. Similarly, the condition shown in area 31 can be identified as a probable train on the rail section. The strain maps as shown in FIG. 5 can further be processed by a preliminary signal reduction, 19, to reduce the data per unit length of rail and per unit time.

In the preliminary signal reduction, the strain map can be processed to form two vectors ($f_T$ and $f_A$). These vectors are then transmitted through 20 to a neural network processor 21. The vectors $f_T$ and $f_A$ represent a concise measurement of the train presence and rail alignment. The vector $f_T$ describes the integrity of the rail track alignment. The second vector $f_A$ is indicative of the bridge structure integrity. In a normal mode of operation $f_T$ and $f_A$ are collinear. However, as damage is incurred either to the rail track, the bridge, or both, the vectors no longer remain collinear. The angle between the vectors $f_T$ and $f_A$ can be used to predict the severity of the hazard.

Figure 6A:
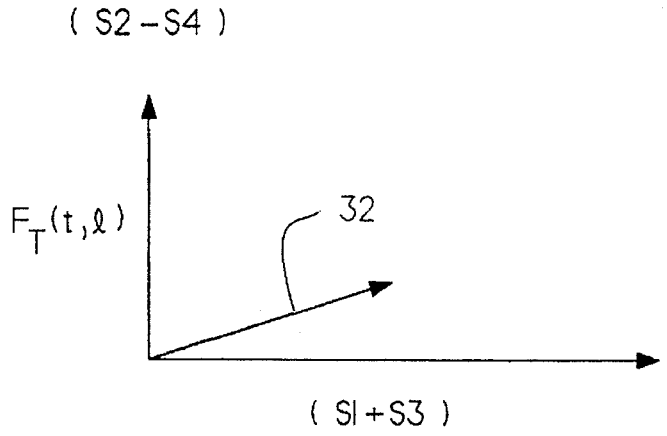
FIG. 6*a* and FIG. 6*b* are graphic representations of vectors $f_T$ and $f_A$ which represent the compressed data for the rail and superstructure descriptors.
Figure 6B:
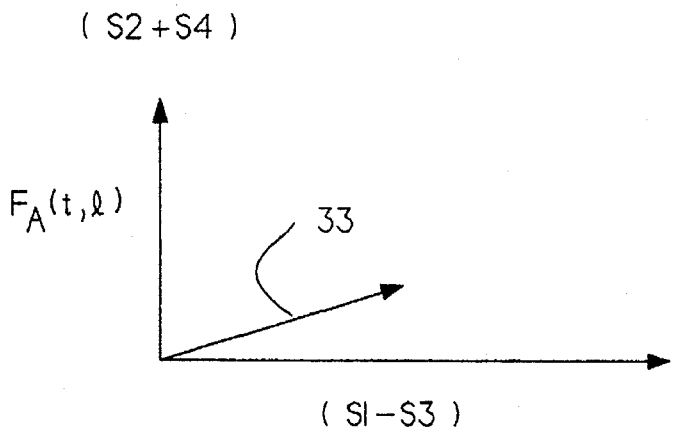

As shown in FIGS. 6*a* and 6*b*, the vectors $f_T$ and $f_A$ are generally collinear. The angle between the vectors can be descriptive of the condition of the structures being monitored. Therefore, angle limitations may be constructed which are indicative of specifically occurring structural conditions. When a given angle limitation is violated, the monitor can indicate the existence of such a condition and at that time, the specific signatures can be queried to establish spatial location of the potential hazard. If the hazard condition is validated by searching the specific sensor information, the monitor can then activate signals to block traffic that is about to enter the bridge zone or can undertake other signalling or annunciation functions.

The signature information can be further processed by feeding through 20 to a neural network processor 21. The neural network data processing is implemented with an information coded technology that allows the processor to be vital. At the same time the vitality can be quantified with an analytical model to provide a robust verification and validation of the entire monitor processing. The neural network processor can be fault tolerant to certain transient failures in hardware execution. The neural network processor 21 processes the signals to reduce the presence and alignment vectors into train presence and misalignment detection. This information is output via 22 and 23 to respective train detection and railway misalignment devices. In addition, when given conditions of a specific application are indicated to be announced, an alarm signal 24 can be used to activate a remote annunciation device. In addition, the neural network processor 21 may include on-going diagnostics to indicate the validity of the information being processed. A valid signal output 25 can also be used with other related train control equipment and signals. The neural network 21 is trained to recognize a set of categories from data obtained for different rail and bridge conditions. The processor is trained to recognize different signature types corresponding to different degrees of hazard rail and bridge conditions. These conditions may also include recognizing typical acceptable conditions such as train occupation of the structure. The particular categories used will depend upon the nature of the sampled data, which could be spatial, spatiotemporal, or sequences of these types. The architecture of the neural network depends upon both the nature of the data to be analyzed and the specific form of the output (e.g., a sample category versus a structured output). These can be divided into three different cases. In the first case the input consists of spatial patterns collected from the spatial array of rail sensors along the bridge. A set of categories may be learned using a two layer Kohonen net. The Kohonen net may use a winner-take-all strategy in order to build a feature map for classifying such patterns. In the second case, the data is spatiotemporal, that is one or more sensors at specific points along the bridge would be sampled over a specified period of time. A spatiotemporal recognizer network which implements a nearest matched filter classification scheme may be used. This network will be able to account for signal warping which may occur because of trains moving at speeds different than the speed for which the initial data was collected during training. The third case is when the data is a sequence of spatial or spatiotemporal patterns. In this case, a recurrent back-propagation network is used. That is, a sequence of spatial signatures describing bridge dynamics would reveal dynamical changes as a train moves over the bridge. In this case, the network may identify bridge structured degradation that, if detected, would send an alarm or an alert to a maintenance mode. A recurrent network is one in which the outputs from one of its layers becomes the input to the same or previous layer, and is combined with the normal input for that layer. In this way, a "context" is created for the current inputs based on previous inputs so that particular behavioral sequences of the structure can be identified.

Figure 7:
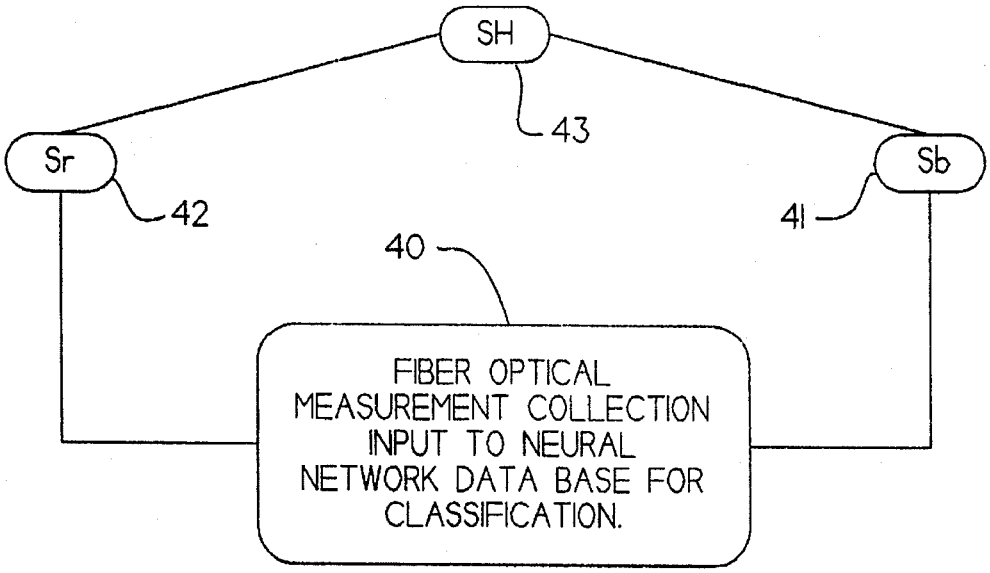
FIG. 7 is a diagrammatic representation of an embodiment of the data flow from a neural network processor.

Fiber optical measurement and collection of network data has been shown. The particular architectural network and data to be processed may be included within the neural network processor. The information flow shown in FIG. 7 contains the fiber optic measurement collection 40. The neural network processor analyzes signatures for the rail (Sr) and signatures for the bridge (Sb), 42, 41, which represent normal as well as increasing pathological states and behavior. The neural network processor is trained to recognize different signature categories. To recognize these different signature categories, the neural network may gather data from normal as well as abnormal rail and bridge states and behaviors to serve as the training set. Training information may be obtained from the specific structure or historical data from a similar structure. For training, a network would be fed input consisting of DSP-filtered fiber optic signals from which it could learn, either unsupervised in the case of the Kohonen network or supervised as in the case of back-propagation learning, the categories for correct signal classification. Consequently, the neural network is able to identify hazards for both the bridge and the rail. The result of these two signatures constitutes a hazard signature (SH), 43. Limits can be set for the individual signatures Sr and Sb in addition to the hazard signal SH. One of the limits for the rail signature (Sr) may be the presence of a train in a normal occupied mode. Depending on the specific application, other desired limits may be set. Train presence information from the predictor can be used with convention railway signal equipment such as track circuits, cab signal, and CTC functions to assist traffic management.

While some specific embodiments of the invention have been described herein, other embodiments will be apparent to those skilled in the art. The invention as claimed includes both the embodiments shown and described herein, and those claimed derived using other technologies.

We claim:

1. A railway hazard predictor for monitoring railway track having rail mounted on a structure comprising:

at least one rail sensor mounted to sense physical characteristics imposed on said rail from a railway vehicle occupying said rail;

at least one alignment sensor mounted intermediate said rail and said structure to sense relative strain between said rail and said structure independent of said physical characteristic sensed by said rail sensor;

collection means for real time collecting data from said rail sensor and said alignment sensor;

processing means for analyzing said data and producing a rail signal indicative of rail integrity and a structure signal indicative of structure integrity; and a neural network for reducing said rail signal and said structural signal into a train presence and misalignment detection.

2. The railway hazard predictor of claim 1 wherein said processing means includes means for providing a presence vector and an alignment vector; and said neural network is sensitive to the angle between said presence vector and said alignment vector.

3. The railway hazard predictor of claim 2 wherein said neural network considers collinearity of said presence vector and said alignment vector as indication of a normal mode.

4. The railway hazard predictor of claim 1 wherein said processing means is at least one of spatial or spatiotemporal.

5. The railway hazard predictor of claim 1 wherein said neural network is a Kohonen net using a winner-take-all strategy to build a feature map for classifying said data.

6. The railway hazard predictor of claim 1 wherein said neural network is a back-propagated neural network using a sequence of spatial data.

7. The railway hazard predictor of claim 1 wherein said rail sensor and said alignment sensor are fiber optic sensors;

said alignment sensor is mounted to sense lateral strain between such rail and a portion of such structure; and said rail sensor is mounted to sense vertical loading on such rail.

8. The railway hazard predictor of claim 1 wherein said processing means includes means for providing a presence vector and an alignment vector;

said neural network is sensitive to the angle between said presence vector and said alignment vector;

said processing means is at least one of spatial or spatiotemporal; and said neural network is a Kohonen net using a winner-take-all strategy to build a feature map for classifying said data.

9. The railway hazard predictor of claim 1 wherein said processing means includes means for providing a presence vector and an alignment vector;

said neural network is sensitive to the angle between said presence vector and said alignment vector;

said processing means is at least one of spatial or spatiotemporal; and said neural network is a back propagated neural network using a sequence of spatial data.

10. A railway hazard predictor for monitoring track having rail mounted on a structure comprising:

a sensor unit having at least one fiber optic rail sensor mounted to sense vertical loading on such rail;

at least one fiber optic alignment sensor mounted to sense lateral strain between such rail and a portion of such structure; and output means for outputting the data from said rail sensor and said alignment sensors to processing means for predicting structural conditions.

11. The railway hazard predictor of claim 10 wherein said at least one fiber optic rail sensor is mounted beneath a portion of such rail; and said at least one fiber optic alignment sensor is mounted to sense strain in a plane generally perpendicular to the strain sensed by said fiber optic rail sensor.

12. The railway hazard predictor of claim 11 wherein said at least one fiber optic alignment sensor includes two fiber optic alignment sensors mounted on opposite sides of such rail.

13. The railway hazard predictor of claim 12 wherein said at least one rail sensor and said two alignment sensors are of length l;

wherein said at least one rail sensor and said two alignment sensors are connected into a single fiber optic output; and said at least one rail sensor and said two alignment sensors are connected to said output through optical delay loops having respective lengths that are integer multiples of l.

14. A method for monitoring railway track having rail mounted on a structure to determine a hazard condition comprising:

sensing physical characteristics imposed on said rail from a railway vehicle occupying said rail;

sensing relative strain between said rail and said structure independent of said physical characteristic;

collecting said physical characteristics and said relative strain as real time data;

processing said data and producing rail signal indicative of rail integrity and structure data indicative of structure integrity; and reducing said rail signal and said structural signal into a train presence and misalignment detection.

15. The method of claim 14 wherein said processing includes providing a presence vector and an alignment vector; and said reducing is sensitive to the angle between said presence vector and said alignment vector.

16. The method of claim 15 wherein said reducing considers collinearity of said presence vector and said alignment vector and indication of a normal mode.

17. The method of claim 14 wherein said processing is at least one of spatial or spatiotemporal.

18. The method of claim 14 wherein said reducing is by a Kohonen net using a winner-take-all strategy and builds a feature map for classifying said data.

19. The method of claim 14 wherein said reducing is by back-propagated neural network using a sequence of spatial data.

20. The method of claim 14 wherein said sensing of physical characteristics uses a fiber optic sensor mounted to sense vertical loading of such rail; and said sensing strain senses lateral strain between such rail and a portion of such structure.

21. The method of claim 14 wherein processing includes providing a presence vector and an alignment vector;

said reducing is sensitive to the angle between said presence vector and said alignment vector;

said processing is at least one of spatial or spatiotemporal; and said reducing uses a Kohonen net using a winner-take-all strategy and builds a feature map for classifying said data.

22. The method of claim 14 wherein said processing includes providing a presence vector and an alignment vector;

said reducing is sensitive to the angle between said presence vector and said alignment vector;

said processing is at least one of spatial or spatiotemporal; and said reducing includes back-propagation of a neural network using a sequence of spatial data.

* * * * *